United States Patent [19]

Hata

[11] Patent Number: 4,729,852

[45] Date of Patent: Mar. 8, 1988

[54] OXIDE SEMICONDUCTOR FOR THERMISTOR

[75] Inventor: Takuoki Hata, Neyagawa, Japan

[73] Assignee: Matsushita Electric Industrial Co., Ltd., Osaka, Japan

[21] Appl. No.: 946,175

[22] PCT Filed: Jul. 16, 1984

[86] PCT No.: PCT/JP84/00364

§ 371 Date: Mar. 12, 1985

§ 102(e) Date: Mar. 12, 1985

[87] PCT Pub. No.: WO85/00690

PCT Pub. Date: Feb. 14, 1985

Related U.S. Application Data

[63] Continuation-in-part of Ser. No. 713,396, Mar. 12, 1985, abandoned.

[30] Foreign Application Priority Data

Jul. 18, 1983 [JP] Japan ..... 58-131265

[51] Int. Cl.[4] ..... H01B 1/06

[52] U.S. Cl. ..... 252/518; 252/519; 252/520; 338/22 R

[58] Field of Search ..... 252/518, 519, 520; 338/22 R

[56] References Cited

U.S. PATENT DOCUMENTS 4,324,702 4/1982 Matsuo et al. ..... 252/519

FOREIGN PATENT DOCUMENTS 88305 7/1980 Japan .
56-85802 7/1981 Japan .
57-184206 11/1982 Japan .

*Primary Examiner*—Josephine Barr
*Attorney, Agent, or Firm*—Stevens, Davis, Miller & Mosher

[57] ABSTRACT

This invention relates to an oxide semiconductor for a thermistor to be used as a sensor mostly in the temperature range of 200° C.–700° C. The semiconductor contains four metal elements, that is, Mn in an amount 65.0–98.5 atom %, Ni in an amount of 0.1–5.0 atom %, Cr in an amount of 0.3–5.0 atom % and Zr in an amount of 0.05–25.0 atom %, the total of the four elements being 100 atom %. This oxide semiconductor for a thermistor has outstanding feature for use as a temperature sensor in the medium to high temperature ranges in that the change of resistance with time at temperatures of 200° C.–700° C. is confined within ±5%, and thus the semiconductor of this invention is most suited for high-temperature determinations where high reliability is required.

4 Claims, 2 Drawing Figures

OXIDE SEMICONDUCTOR FOR THERMISTOR

This application is a continuation-in-part of application Ser. No. 713,396 filed Mar. 12, 1985, abandoned.

TECHNICAL FIELD

This invention relates to oxide semiconductors for thermistors used mostly in the temperature range of 200° C. to 700° C.

BACKGROUND ART

Thermistors basically composed of Mn oxides and Co oxides have been widely used. These thermistors are generally composed of Mn-Co, Mn-Co-Cu, Mn-Co-Ni or Mn-Co-Ni-Cu oxide systems and have been used as general-purpose disc type thermistors, typically for temperature compensation. Such thermistors are typified by their specific resistance ranging from 10-odd Ω·cm to 100-odd KΩ·cm and have been applied to uses mostly in the temperature range of from −40° C. to 150° C. Recently, these thermistors have come to be used increasingly as temperature sensors, and request is growing for thermistor sensors which can be used at higher temperatures.

As the first stage, the thermistor sensors that can stand use at high temperatures up to 300° C. have been required for use in temperature control of solar systems or oil combustion devices. To meet such requirement, studies have been made on thermistor materials having higher specific resistance than the conventional Co-Mn oxide-based materials, and consequently, there have been developed and put to commercial use an Mn-Ni-Al system oxide semiconductor (Japanese Patent Laid-Open No. 95603/82) and Mn-Ni-Cr-Zr system oxide semiconductor (U.S. Pat. No. 4,324,702), the latter having been proposed by the present inventors.

In the aspect of sensor structure, in order to protect the resin-molded structure of conventional disc type thermistors from high-temperature ambient air, it has been proposed to encapsulate micro-thermistor elements having a size of about 500 μm×500 μm×300 μm(t) in a glass tube or coat such thermistor elements with glass by dip coating. Bead type thermistors, like said disc type, have been also glass coated to improve heat resistance.

However, the demand for the thermistors usable at higher temperatures was not confined there; now the request is growing for the sensors that can be used at temperatures of not lower than 300° C. up to 500° C. or 700° C. The currently available materials have the following two problems in meeting such requirement: (1) they are low in specific resistance which is one of the characteristics of thermistor materials, so that it is impossible with these materials to obtain a resistance required for operating the device at a desired high temperature; (2) the change of resistance with time in these materials at high temperatures exceeds the highest permissible level of 5% (at 500° C. in 1,000 hours), and thus they lack reliability in practical use.

On the other hand, stabilized zirconia ($ZrO_3$-$Y_2O_3$, $ZrO_2$-CaO, etc.) and Mg-Al-Cr-Fe oxide compositions have been developed as materials usable at high temperature of 700° C. to 1,000° C. However, the calcining temperature of these oxide materials should also be above 1,600° C., and these materials cannot be calcined with an ordinary electric furnace (max. temp. 1,600° C.). Further, even the sintered bodies of these oxide materials suffer a wide change of resistance with time at high temperatures, such change being of the order of 10% (1,000 hrs.) in the most stable ones. Thus, a further improvement of reliability has been required of these materials.

Novel materials that can overcome this problem have already been proposed in Japan, but they are still in the stage of evaluation. (Mn-Zr-Ni oxides: Japanese Patent Laid-Open No. 88305/80; $(Ni_XMg_YZn_Z)Mn_2O_4$ spinel type: Japanese Patent Laid-Open No. 88701/82; $(Ni_pCo_qFe_rAl_sMn_t)O_4$ spinel type: Japanese Patent Laid-Open No. 88702/82).

DISCLOSURE OF INVENTION

In view of the above, the present invention provides an improved oxide semiconductor to be used as a thermistor, said semiconductor being characterized by containing four metal elements; manganese (Mn), nickel (Ni), chromium (Cr) and zirconium (Zr) in amounts of 67.0–83.6 atom %, 0.1–5.0 atom %, 0.3–5.0 atom % and 16.0–25.0 atom %, respectively, the total of said four elements being 100 atom %, and having high reliability with the change of resistance after 1,000 hours at 450° C. being confined within ±5%.

BEST MODES FOR CARRYING OUT THE INVENTION

Figure 1:
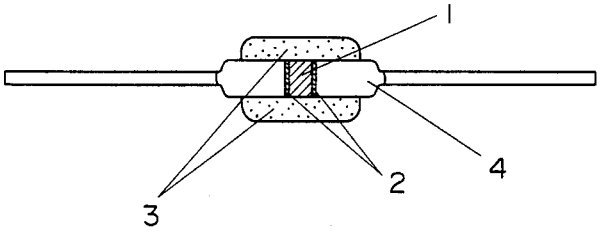
FIG. 1 is a sectional front view of a glass-encapsulated thermistor made on an experimental basis by using a composition according to this invention.

This invention proposes an oxide semiconductor for thermistor containing four metal elements, that is, manganese (Mn), nickel (Ni), chromium (Cr) and zirconium (Zr) in amounts of 67.0–83.6 atom %, 0.1–3.0 atom %, 0.3–5.0 atom % and 16.0–25.0 atom %, respectively, the total of said four elements being 100 atom %, which has been deviced after many runs of tests and experiments.

The invention also proposes an oxide semiconductor for thermistor containing silicon (Si) in an amount of 2.0 atom % or less (exclusive of 0 atom %) in addition to the above-mentioned composition comprising, as metal elements, 67.0–83.6 atom % of manganese (Mn), 0.1–3.0 atom % of nickel (Ni), 0.3–5.0 atom % of chromium (Cr) and 16.0–25.0 atom % of zirconium (Zr), the total of the four elements being 100 atom %. The present invention will be described below with relation to the embodiments thereof.

First, commercially available starting materials. $MnCO_3$, NiO, $Cr_2O_3$, $ZrO_2$ and $SiO_2$ were mixed in ratios shown by atom % in Table 1 below. The materials were mixed well in a ball mill, then dried and calcined at 1,000° C. for 2 hours. The resulting mixture was again crushed in a ball mill and the obtained slurry was dried. Then polyvinyl alcohol was added as a binder. Suitable amounts of the resulting product were taken and press molded to form many disc-shaped moldings and these moldings were sintered in air at 1,320° C. for 2 hours, and then the electrodes basically made of Ag were printed to both the sides of each disc-shaped sintered body (about 7 mm in diameter and about 1.5 mm in thickness) to obtain an ohmic contact. The values of resistance at 25° C. and 50° C. (shown as $R_{25°\,C.}$ and $R_{50°\,C.}$) of these specimens were determined, and the resistivity at 25° C. ($\rho_{25°C.}$) was calculated from the following formula (1) and the B constant from the following formula (2):

$$\rho_{25°C.} = R_{25°C.} \times \frac{S}{d} \quad (1)$$

(S: electrode area, d: distance between electrodes)

$$B = 8.868 \times 10^3 \times \log \frac{R_{25°C.}}{R_{50°C.}} \quad (2)$$

Further, said disc-shaped sintered bodies made from some of the compositions were abraded to a thickness of 150–400 μm, and then the electrodes basically made of Pt were screen printed to both the sides of each said sintered body. The resulting product was cut to a square form with a side length of 400 μm and encapsulated in a glass tube. Terminals were led out with slug leads. Each of the thus obtained glass-encapsulated thermistors was left in air at 450° C. for 1,000 hours and the rate of change of resistance with time was determined. The results are shown in Table 1.

TABLE 1

| Specimen | Composition (atom %) | | | | | ρ25° C. | B | Rate of change of resistance with time at 450° C. |
|---|---|---|---|---|---|---|---|---|
| No. | Mn | Ni | Cr | Zr | Si | (Ω · cm) | (K) | (%) |
| *1 | 90.0 | 5.0 | 5.0 | 0 | 0 | 87.6K | 4520 | +21.0 |
| 2 | 92.2 | 2.5 | 5.0 | 0.3 | 0 | 240K | 4930 | +5.0 |
| 3 | 83.1 | 2.3 | 4.6 | 10.0 | 0 | 328K | 5460 | +3.7 |
| 4 | 71.0 | 2.0 | 2.0 | 25.0 | 0 | 716K | 5750 | +3.8 |
| *5 | 66.0 | 2.0 | 2.0 | 30.0 | 0 | 820K | 5820 | +6.5 |
| 6 | 85.0 | 2.5 | 2.5 | 10.0 | 1.0 | 760K | 5840 | +4.1 |
| 7 | 85.0 | 2.5 | 2.5 | 10.0 | 2.0 | 1.28 M | 6040 | +4.7 |
| *9 | 82.4 | 5.1 | 2.5 | 10.0 | 0 | 98.6K | 4630 | +15.3 |
| *10 | 87.5 | 0 | 2.5 | 10.0 | 0 | 421K | 5490 | +7.1 |
| *11 | 87.3 | 2.5 | 0.2 | 10.0 | 0 | 274K | 5120 | +17.8 |
| *12 | 84.8 | 0.1 | 5.1 | 10.0 | 0 | 564K | 5380 | +5.5 |
| *13 | 86.0 | 2.0 | 2.0 | 10.0 | 0 | 443K | 5730 | +3.8 |
| 14 | 86.0 | 2.0 | 2.0 | 10.0 | 1.0 | 986K | 5970 | +3.4 |
| 17 | 79.5 | 2.0 | 2.0 | 16.5 | 0 | 520K | 5730 | +4.7 |
| 18 | 80.0 | 5.0 | 5.0 | 10.0 | 0 | 168K | 4650 | +4.8 |
| *19 | 79.6 | 5.2 | 5.2 | 10.0 | 0 | 97.5K | 4580 | +5.6 |
| *20 | 82.9 | 2.0 | 5.0 | 10.0 | 0.6 | 387K | 5570 | +5.2 |
| 21 | 75.0 | 3.0 | 2.0 | 20.0 | 0 | 363K | 5670 | +4.4 |
| 22 | 79.0 | 3.5 | 1.0 | 16.5 | 0 | 307K | 5610 | +4.1 |
| *23 | 66.5 | 3.5 | 5.0 | 25.0 | 0 | 274K | 5540 | +5.1 |
| *24 | 85.9 | 0.1 | 1.0 | 13.0 | 0 | 1.78 M | 5930 | +6.2 |
| 25 | 83.0 | 0.1 | 0.4 | 16.5 | 0 | 1.38 M | 5780 | +4.2 |
| 26 | 76.0 | 2.0 | 2.0 | 20.0 | 1.0 | 1.45 M | 5840 | +4.3 |
| 27 | 76.0 | 2.0 | 2.0 | 20.0 | 2.0 | 2.14 M | 5960 | +4.6 |
| *28 | 76.0 | 2.0 | 2.0 | 20.0 | 2.5 | 2.91 M | 6080 | +7.7 |
| *29 | 81.0 | 1.0 | 5.0 | 13.0 | 0 | 740K | 5800 | +6.4 |
| 30 | 77.0 | 2.5 | 4.0 | 16.5 | 0 | 410K | 5660 | +2.9 |

*Comparative specimens, not included within the scope of this invention.

As seen from Table 1, Specimens Nos. 1 and 10, which are three-component comparative specimens, and Specimens Nos. 5, 8, 9, 11, 12, 19, 20, 23, 24, 28 and 29 which are also comparative specimens, were all as high as +5.0% or higher in the rate of change of resistance with time at 450° C. and lack reliability for practical use. Specimens Nos. 2, 3 and 13 have a lower resisitivty at 25° C., which is not preferred in the present invention.

The specimens tested were the thermistors obtained by glass-encapsulating the chip-shaped elements, but the thermistors may be bead-shaped and glass coated. The latter type would have a slight variation of characteristic values determined above, but the oxide semiconductors for thermistors according to this invention are in no way restrained by the production process.

In the embodiments of this invention, when agate gemstone was used for mixing a starting materials and for crushing and mixing calcined materials, the amount of Si incorporated in the composition was less than 0.2 atom % as calculated based on 100 atom % of thermistor composing elements in all specimens, and when zirconia gemstone was used for said purpose, the amount of Zr mixed was less than 0.5 atom %.

FIG. 1 shows a glass-encapsulated thermistor of the type described above, wherein numeral 1 denotes a thermistor element according to this invention, 2 Pt-based electrodes, 3 glass, and 4 slug leads.

Figure 2:
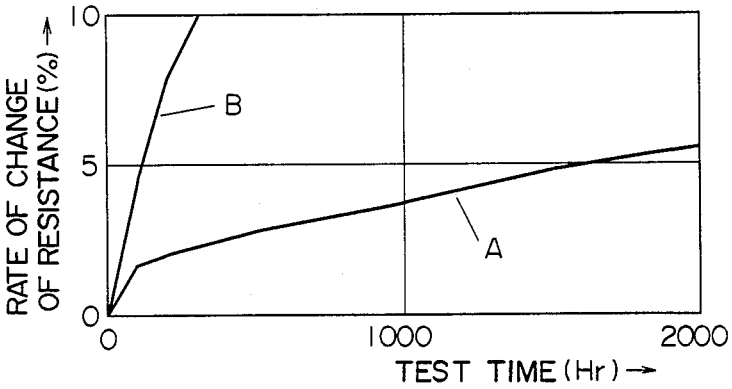
FIG. 2 is a graph showing the change of resistance with time, at 450° C., of a glass-encapsulated thermistor made by using a composition of this invention.

FIG. 2 shows the result of a life test at 450° C. in the first embodiment (Specimen No. 4) of this invention. In the graph of FIG. 2, straight line A indicates the test result on a glass-encapsulated thermistor according to this invention, and straight line B indicates the test result in a glass-encapsulated thermistor using a conventional Mn-Ni-Cr oxide semiconductor.

Next, the embodiment using a composition containing five metal elements Mn, Ni, Cr, zinc (Zn) and Zr in a total amount of 100 atom % is described. According to this embodiment is provided an oxide semiconductor for a thermistor containing said five elements, that is, Mn in an amount of 65.0–98.5 atom %, Ni in an amount of 0.1–5.0 atom %, Cr in an amount of 0.3–5.0 atom %, Zn in an amount of 0.3–5.0 atom % and Zr in an amount of 0.05–25.0 atom %, the total of said five elements being 100 atom %. Also here is described an embodiment in which Si is added in an outer percent to said five-element composition. The latter embodiment provides an oxide semiconductor for a thermistor containing silicon (Si) in an amount of 2.0 atom % or less (exclusive of 0 atom %) in outer percent to said composition comprising 65.0–98.5 atom % of Mn, 0.1–5.0 atom % of Ni, 0.3–5.0 atom % of Cr, 0.3–5.0 atom % of Zn and 0.05–25.0 atom % of Zr, the total of the five elements being 100 atom %.

First, the specimens having the compositions shown by atom % in Table 2 below were prepared by using commercially available starting materials. In the compositions, ZnO was used to provide the specified ratio of Zn, and $SiO_2$ was used to provide the specified ratio of Si. The value of Si shown in the table is the amount of Si added in outer percent to the five-component composition.

Each mixture was crushed to form a slurry in the same way as in the first embodiment described above. This slurry was dried, admixed with polyvinyl alcohol as a binder, molded into blocks of 30 mm $\phi \times 15$ mm t and calcined at 1,300° C.–1,500° C. for 2–4 hours. From the thus obtained blockes, 150–400 μm thick wafers were formed by means of slicing and abrasion, and Pt-based electrodes were provided on both the sides of each of said wafers by screen printing.

Thereafter, the same operations as in the first embodiment were followed to produce the glass-encapsulated thermistor sensors and their characteristic properties were determined according to the procedure of said first embodiment, the results being shown in Table 2. In the columns of characteristic properties, a "resistance at 500° C." is the resistance of the sensor and B constant was determined from the resistance at 300° C. and 500° C. The rate of change of resistance with time at 500° C.

were determined from the resistance after the passage of 1,000 hours.

TABLE 2

| Specimen No. | Composition (atom %) Mn | Ni | Cr | Zn | Zr | Si | Resistance at 500° C. (Ω) | B (K) | Rate of change of resistance with time at 500° C. (%) |
|---|---|---|---|---|---|---|---|---|---|
| *101 | 90.0 | 5.0 | 5.0 | 0 | 0 | — | $8.7\times10$ | 4640 | +8.4 |
| *102 | 90.0 | 5.0 | 0 | 5.0 | 0 | — | $2.0\times10^2$ | 4700 | +10.9 |
| *103 | 90.0 | 0 | 5.0 | 5.0 | 0 | — | $2.1\times10^2$ | 5300 | +8.6 |
| *104 | 95.0 | 2.5 | 2.5 | 0 | 0 | — | $1.2\times10^2$ | 4600 | +6.3 |
| *105 | 95.0 | 1.0 | 2.5 | 1.5 | 0 | — | $1.8\times10^2$ | 4930 | +7.0 |
| *106 | 95.0 | 2.5 | 1.5 | 1.0 | 0 | — | $1.5\times10^2$ | 4680 | +8.2 |
| 107 | 94.9 | 1.0 | 2.5 | 1.5 | 0.1 | | $2.3\times10^2$ | 4900 | +4.8 |
| 108 | 85.0 | 1.0 | 2.5 | 1.5 | 10.0 | — | $1.6\times10^3$ | 5800 | +2.7 |
| 109 | 70.0 | 1.0 | 2.5 | 1.5 | 25.0 | — | $4.0\times10^3$ | 5740 | +3.2 |
| *110 | 65.0 | 1.0 | 2.5 | 1.5 | 30.0 | — | $1.8\times10^4$ | 5830 | +5.1 |
| *111 | 85.8 | 2.5 | 0.2 | 1.5 | 10.0 | — | $2.2\times10^2$ | 5600 | +5.3 |
| *112 | 84.0 | 0 | 2.5 | 1.5 | 10.0 | — | $6.4\times10^3$ | 5400 | +5.7 |
| *113 | 81.0 | 6.0 | 1.5 | 1.5 | 10.0 | — | $2.3\times10^2$ | 4900 | +7.1 |
| *114 | 80.0 | 2.5 | 6.0 | 1.5 | 10.0 | — | $4.3\times10^2$ | 5250 | +5.3 |
| *115 | 77.5 | 2.5 | 2.5 | 7.5 | 10.0 | — | $3.9\times10^2$ | 5280 | +6.2 |
| 116 | 80.0 | 5.0 | 2.5 | 1.5 | 15.0 | — | $6.4\times10^3$ | 5340 | +4.2 |
| 117 | 82.2 | 2.5 | 0.5 | 4.8 | 10.0 | — | $7.8\times10^2$ | 5210 | +3.7 |
| 118 | 82.2 | 2.5 | 4.8 | 0.5 | 10.0 | — | $5.6\times10^2$ | 5360 | +4.4 |
| 119 | 79.7 | 0.3 | 2.5 | 2.5 | 15.0 | — | $1.0\times10^3$ | 5590 | +3.2 |
| 120 | 65.0 | 5.0 | 2.5 | 2.5 | 25.0 | — | $1.6\times10^3$ | 5800 | +4.5 |
| *121 | 60.0 | 5.0 | 5.0 | 5.0 | 25.0 | — | $8.9\times10^2$ | 5650 | +5.9 |
| 122 | 80.0 | 1.0 | 2.5 | 1.5 | 15.0 | 0.3 | $1.4\times10^3$ | 6030 | +2.9 |
| 123 | 80.0 | 1.0 | 2.5 | 1.5 | 15.0 | 1.0 | $2.8\times10^3$ | 6150 | +2.6 |
| 124 | 80.0 | 1.0 | 2.5 | 1.5 | 15.0 | 2.0 | $1.9\times10^3$ | 6200 | +3.8 |
| *125 | 80.0 | 1.0 | 2.5 | 1.5 | 15.0 | 2.5 | $3.1\times10^3$ | 6180 | +5.2 |

*Comparative specimens, not included within the scope of this invention.

In Table 2, Specimen Nos. 101–106 are three-component or four-component comparative specimens and Specimen Nos. 110–115, 121 and 125 are also comparative specimens, and as seen from Table 2, all of these comparative specimens were as high as +5% or higher in the rate of change or resistance with time at 500° C. and lacked reliability for practical use. The tested specimens of this invention in this embodiment are glass-encapsulated thermistor sensors, but the products of this invention also include bead-type thermistors obtained by glass-dipping the elements, and the latter type is in no way restrained by said production method. In the above-described second embodiment, zirconia gemstons was used for mixing starting materials and for crushing and mixing calcined materials, but the amount of Zr which has got mixed in the composition was less than 0.5 atom % to 100 atom % of thermistor composing elements in all the specimens.

In the compositions shown above, the primary effect of addition of Zn is to increase resistivity while the addition of Zr has the effect of stabilizing the composition at high temperatures. The effect of addition of $SiO_2$ is to increase denseness of the product by promoted sintering and to control specific resistance.

The definitions of said compositional ratios of materials are based on the rate of change of resistance within ±5% (after 1,000 hours) in the high-temperature life test, and the compositions which showed a rate of change of resistance greater than ±5% were excluded from the scope of this invention as shown in Tables 1 and 2. The high-temperature life test was conducted at 450° C. in the first embodiment and at 500° C. in the second embodiment, but it was confirmed that the specimens optionally selected from said specified compositions were confined within ±5% in the rate of change of resistance even in the test at 700° C.

INDUSTRIAL APPLICABILITY

As described above, the oxide semiconductors for thermistors according to this invention have excellent adaptability as a temperature sensor for use in the medium to high temperature ranges. Typically, the change of resistance with time of said semiconductors at temperatures of 200° C.–700° C. is within ±5%, and thus said semiconductors are most suited for high-temperature determination where especially high reliability is required. For instance, the semiconductors according to this invention prove to be of much utility in such field of utilization as temperature control of electronic oven or temperature control of preheating pot of oil fan heater.

What is claimed is:

1. An oxide semiconductor for a thermistor to be used as a temperature sensor in the range 300°–700° C., characterized by containing the following four metal elements: Mn, Ni, Cr and Zr in amounts of 67.0–83.6 atom %, 0.1–3.0 atom %, 0.3–5.0 atom % and 0.05–16.0 atom %, respectively, the total amount of said four metal elements being 100 atom %.

2. An oxide semiconductor for a thermistor to be used as a temperature sensor in the range 300°–700° C., characterized by containing the following four metal elements: Mn, Ni, Cr and Zr in amounts of 67.0–83.6 atom %, 0.1–3.0 atom %, 0.3–5.0 atoms % and 16.0–25.0 atom %, respectively, the total amount of said four metal elements being 100 atom %, and further containing Si in an amount of 2.0 atom % or less (exclusive of 0 atom %) based on the total amount of said main components.

3. An oxide semiconductor for a thermistor to be used as a temperature sensor in the range 300°–700° C., characterized by containing the following five metal elements: Mn, Ni, Cr, Zn and Zr in amounts of 65.0–98.5 atom %, 0.1–5.0 atom %, 0.3–5.0 atom %, 0.3–5.0 atom % and 0.05–25.0 atom %, respectively, the total amount of said five metal elements being 100 atom %.

4. An oxide semiconductor for a thermistor, to be used as a temperature sensor in the range 300°–700° C., characterized by containing the following five metal elements: Mn, Ni, Cr, Zn and Zr in amounts of 65.0–98.5 atom %, 0.1–5.0 atom %, 0.3–5.0 atom %, 0.3–5.0 atom % and 0.05–25.0 atom %, respectively, the total amount of said five metal elements being 100 atom and further containing Si in an amount of 2.0 atom % or less (exclusive of 0 atom %) based on the total amount of said main components.

* * * * *